US012163385B1

(12) United States Patent
Shaarawi et al.

(10) Patent No.: US 12,163,385 B1
(45) Date of Patent: Dec. 10, 2024

(54) METHOD AND APPARATUS FOR DOWNHOLE IN-SITU MIXING USING DUAL, CONCENTRIC FLOW CHANNELS

(71) Applicant: SAUDI ARABIAN OIL COMPANY, Dhahran (SA)

(72) Inventors: Amjad Shaarawi, Khobar (SA); Mohammed Alsheikh, Dammam (SA); Abdulwahab Aljohar, Dhahran (SA); Abdullah Al-Yami, Dhahran (SA); Vikrant Wagle, Dhahran (SA); Sara Abdulaziz Alkhalaf, Thuwal (SA); Carl Daniel Lindahl, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/340,694

(22) Filed: Jun. 23, 2023

(51) Int. Cl.
*E21B 21/00* (2006.01)
*E21B 21/10* (2006.01)

(52) U.S. Cl.
CPC ..... *E21B 21/003* (2013.01); *E21B 21/10* (2013.01); *E21B 2200/05* (2020.05); *E21B 2200/06* (2020.05)

(58) Field of Classification Search
CPC ..... E21B 31/00; E21B 21/003; E21B 21/10; E21B 21/103; E21B 21/106; E21B 33/00; E21B 21/12; E21B 21/14; E21B 21/13; E21B 2200/05; E21B 2200/06; E21B 2200/02
See application file for complete search history.

(56) References Cited

U.S. PATENT DOCUMENTS 3,448,800 A * 6/1969 Wahl ..... E21B 33/138 175/72
3,637,019 A 1/1972 Lee
(Continued)

FOREIGN PATENT DOCUMENTS

| | | | |
|---|---|---|---|
| RU | 2010949 | C1 | 4/1994 |
| WO | 2013104770 | A2 | 7/2013 |
| WO | 2022132552 | A1 | 6/2022 |

OTHER PUBLICATIONS

Al-Yami et al., "New Developed Acid Soluble Cement and Sodium Silicate Gel to Cure Lost Circulation Zones," Society of Petroleum Engineers, SPE-172020-MS, Nov. 2014, 10 pages.
(Continued)

*Primary Examiner* — Angela M DiTrani Leff
(74) *Attorney, Agent, or Firm* — Osha Bergman Watanabe & Burton LLP

(57) ABSTRACT

A tool for use in a wellbore includes an annular body having an inner flow passage extending axially therethrough, at least one gripping member positioned around an outer perimeter of a retainer section of the annular body, and a gate member positioned in the inner flow passage. When the gate member is in a closed configuration, an upstream portion of the inner flow passage is sealed from a downstream portion of the inner flow passage by the gate member. When the gate member is in an open configuration, the upstream portion of the inner flow passage is fluidly connected to the downstream portion of the inner flow passage. At least one static mixing blade extends through the downstream portion of the inner flow passage to mix fluid when it flows through the open gate member.

12 Claims, 8 Drawing Sheets

(56) References Cited

U.S. PATENT DOCUMENTS 3,727,691 A * 4/1973 Muecke ..... E21B 41/00 166/149
4,064,941 A * 12/1977 Smith ..... E21B 43/25 166/305.1
4,361,187 A * 11/1982 Luers ..... E21B 34/06 137/896
4,449,856 A * 5/1984 Tokoro ..... E02D 3/12 405/269
5,343,968 A * 9/1994 Glowka ..... E21B 33/138 175/215
5,409,071 A * 4/1995 Wellington ..... E21B 47/005 166/290
5,582,251 A 12/1996 Bailey et al.
6,192,983 B1 * 2/2001 Neuroth ..... E21B 43/12 166/250.15
6,497,290 B1 12/2002 Misselbrook et al.
7,500,520 B2 3/2009 Al-Dhafeeri et al.
9,810,049 B2 11/2017 Dean et al.
10,783,678 B2 9/2020 Albrighton et al.
11,221,187 B2 1/2022 Kearney
11,732,535 B2 * 8/2023 Quero ..... E21B 33/14 166/305.1
2005/0199390 A1 * 9/2005 Curtice ..... E21B 33/13 166/250.14
2011/0155390 A1 * 6/2011 Lannom ..... E21B 43/121 166/107
2013/0277047 A1 * 10/2013 Kuhn de Chizelle ..... E21B 17/203 166/305.1
2019/0002754 A1 * 1/2019 Yang ..... E21B 43/25
2019/0003281 A1 1/2019 Cornelissen et al.
2021/0040821 A1 * 2/2021 Hoffman ..... E21B 33/12
2023/0175342 A1 * 6/2023 Burguieres ..... E21B 33/12 166/305.1
2024/0026749 A1 * 1/2024 Benet ..... E21B 33/138

OTHER PUBLICATIONS

Schlumberger, "The Defining Series: Well Cementing Fudamentals," 2012, 10 pages.

* cited by examiner

METHOD AND APPARATUS FOR DOWNHOLE IN-SITU MIXING USING DUAL, CONCENTRIC FLOW CHANNELS

BACKGROUND

During drilling operations of an oil or gas well, drilling mud must be pumped through drill pipes and continuously circulated for several critical reasons. Drilling mud carries cuttings out of the wellbore and to the surface and acts to cool the drill bit to prevent overheating. Furthermore, drilling mud circulation asserts hydrostatic pressure on the walls of the well, preventing the walls from collapsing and preventing undesired influx of hydrocarbons and other fluids into the mud. A certain amount of mud is normally lost to the wellbore. However, when the amount becomes substantial, it can lead to loss of control of the well and is commonly referred to as total losses, lost circulation, or loss of circulation.

Lost circulation can be initiated by either natural or induced causes. Natural causes include encounters with naturally fractured or unconsolidated formations. Induced losses occur when the hydrostatic fluid pressure (the pressure exerted by the drilling mud on the walls of the well) exceeds the fracture gradient of the formation (the maximum pressure after which the formation breaks) and the formation pores break down enough to receive rather than resist the fluid. Lost circulation may cause significant setbacks in well drilling operations and add substantially to the overall cost and time of a well.

The process for treating lost circulation typically consists of pumping lost circulation materials (LCMs) into fractured zones in order to plug said zones and prevent further loss of drilling mud to the formation. LCMs include fibrous, flaked, or granular materials and chemical systems such as cement or other combinations of chemicals which harden or cure in the loss zone. Current practice calls for pumping pre-mixed chemical systems from the wellhead which are intended to harden or cure in the loss zone downhole. Calculated reaction rates are often designed to be delayed such that the reaction would begin when the lost circulation zone is reached. However, this can lead to chemical reactions beginning too soon and setting inside the drill pipe or beginning too late so that the LCM is lost into the loss zone and does not effectively plug the fracture.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to tools for use in a wellbore that include an annular body having an inner flow passage extending axially therethrough, at least one gripping member positioned around an outer perimeter of a retainer section of the annular body, and a gate member positioned in the inner flow passage. When the gate member is in a closed configuration, an upstream portion of the inner flow passage is sealed from a downstream portion of the inner flow passage by the gate member. When the gate member is in an open configuration, the upstream portion of the inner flow passage is fluidly connected to the downstream portion of the inner flow passage. At least one static mixing blade may extend through the downstream portion of the inner flow passage to mix fluid when it flows through the open gate member.

In another aspect, embodiments disclosed herein relate to methods for sealing a downhole location in a wellbore. The methods may include setting a retainer-mixer assembly (RMA) tool at a location uphole of the downhole location, wherein the RMA tool includes an annular body having an inner flow passage formed axially therethrough, at least one gripping member positioned around an outer perimeter of a retainer section of the annular body, a gate member positioned in the inner flow passage, and a static mixer section of the annular body having at least one static mixing blade extending through a downstream portion of the flow passage. When the gate member is in a closed configuration, an upstream portion of the inner flow passage is sealed from the downstream portion of the inner flow passage by the gate member, and when the gate member is in an open configuration, the upstream portion of the inner flow passage is fluidly connected to the downstream portion of the inner flow passage. Methods may further include inserting an end of a dual path tubing into the RMA tool, wherein the dual path tubing has a first flow path concentrically positioned within a second flow path, pumping a first fluid in the first flow path through the retainer section of the RMA tool, and pumping a second fluid in the second flow path through the retainer section of the RMA tool. The first fluid and the second fluid are mixed in the static mixer section to form a curing composition, which may be used to fill the downhole location. The curing composition is allowed to set, and the dual path tubing may be removed from the wellbore.

In yet another aspect, embodiments disclosed herein relate to systems for sealing a section of a well. A system may include a dual path tubing extending into the well from surface equipment at an opening of the well, and an RMA tool connected at an axial end of the dual path tubing. The RMA tool may include an annular body having an inner flow passage formed axially therethrough, at least one gripping member positioned around an outer perimeter of a retainer section of the annular body, a gate member positioned in the inner flow passage, and a static mixer section of the annular body having at least one static mixing blade extending through a downstream portion of the inner flow passage. When the gate member is in a closed configuration, an upstream portion of the inner flow passage is sealed from the downstream portion of the inner flow passage by the gate member, and when the gate member is in an open configuration, the upstream portion of the inner flow passage is fluidly connected to the downstream portion of the inner flow passage.

Other aspects and advantages of the claimed subject matter will be apparent from the following description and the appended claims.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
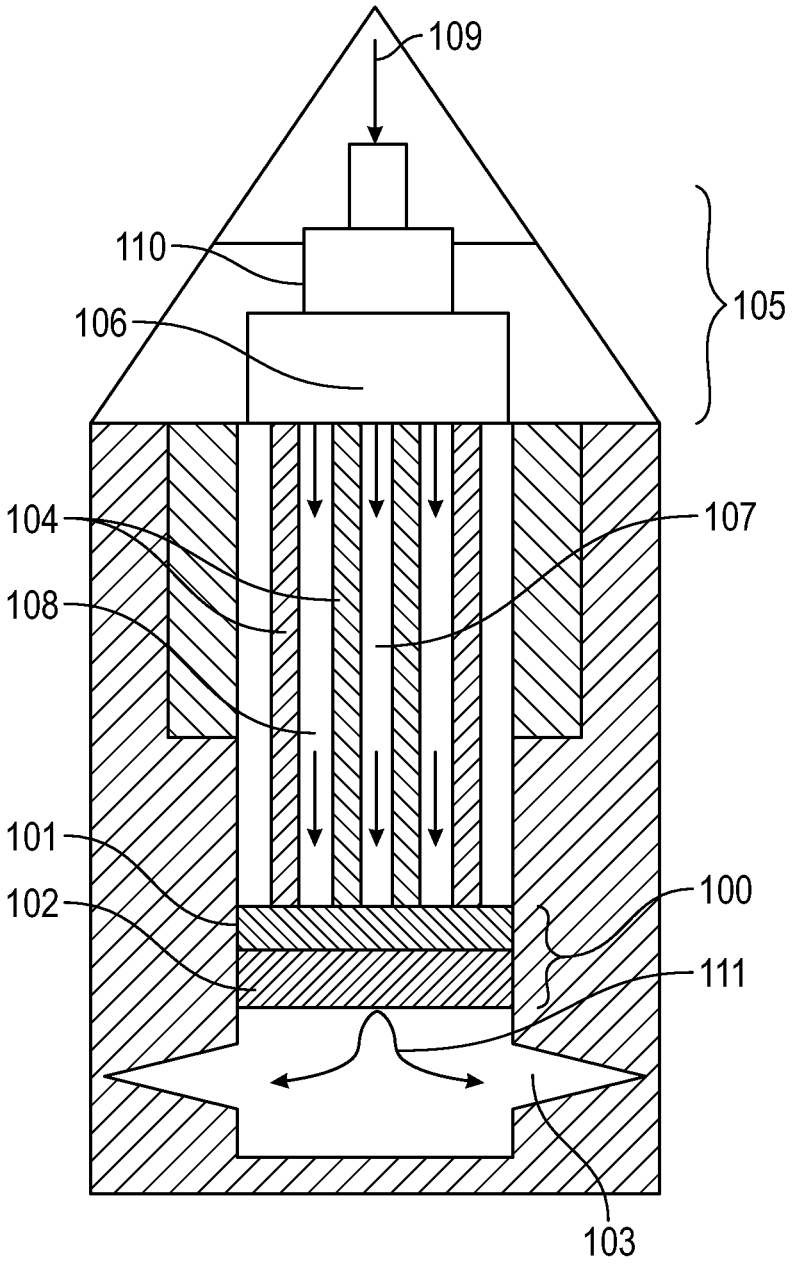
FIG. 1 is a generalized schematic illustrating a system and method for sealing a section of a well which is described in one or more embodiments herein.

In the following detailed description, certain specific details are set forth in order to provide a thorough understanding of various disclosed implementations and embodiments. However, one skilled in the relevant art will recognize that implementations and embodiments may be practiced without one or more of these specific details, or with other methods, components, materials, and so forth. In other instances, well known features or processes associated with the hydrocarbon production systems have not been shown or described in detail to avoid unnecessarily obscuring descriptions of the implementations and embodiments. For the sake of continuity, and in the interest of conciseness, same or similar reference characters may be used for same or similar objects in multiple figures.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before". "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments in accordance with the present disclosure generally relate to a method and apparatus to enable mixing of fluids, in-situ in the wellbore, immediately prior to delivery into a loss circulation zone. One or more embodiments relate to compositions and methods that can improve loss circulation problems encountered in the presence of permeable formations.

Lost circulation materials (LCM) are used to mitigate drilling mud loss to fractures by blocking its path into the formation. The type of LCM used in a lost circulation situation depends on the extent of lost circulation and the type of formation. Different types of LCMs such as particulate, granular, fibrous and flaky materials are frequently used, either alone or in combination, to control loss of circulation. LCMs may also consist of chemical systems which are designed to react and harden or cure downhole in the lost circulation zone.

Examples of curing compositions which can be used as LCMs are cement, acid soluble cement, and other carefully designed chemical systems, such as epoxies, nanosilica dispersions, and the like. Curing compositions useful to one or more embodiments disclosed herein will be discussed in more detail in the following sections.

Although many loss control materials (LCMs) products and methods exist to prevent and mitigate lost circulation of oil and gas wells, there remains room for improvement in placement and activation timescale of these materials. Typically, the reaction rates are controlled by temperature (temperature-triggered reactions). Industry currently relies on designing delayed reaction rates for these chemical systems which are mixed at the surface of the well and pumped downhole at calculated rates such that the reaction would start by the time they arrive at the lost circulation zone. However, if the timescale needed to activate or solidify is too short, these chemicals will set prematurely inside the pipe used for pumping and cause the job to fail. On the other hand, when this timescale is increased with the required safety factors, it becomes too long, and LCMs are lost inside the fractures away from the wellbore at a timescale much faster than that needed for setting. The designed reaction times are typically very long-on the order or several minutes to hours. In the case of total loss of circulation, traditional methods and LCM systems are often insufficient to regain control of the well.

Inaccuracy associated with the timing of triggering chemical reactions required to solidify LCMs and therefore, the inaccuracy associated with placement of LCMs is a major disadvantage of current practices to plug lost circulation zones in wellbores. Proposed herein are methods for creating an accelerated reaction that would be impossible to pump from the surface of the well by conventional methods, whereby two streams containing two different fluids react when they are mixed in-situ, downhole, immediately prior to entering the loss zone.

One or more embodiments of the present disclosure relate to a method and apparatus to enable mixing of LCMs in-situ, at a lost circulation zone. Embodiments also relate to an LCM curing composition which sets at an accelerated time scale compared to traditional LCM materials and would therefore be impossible to pump pre-mixed from the well's surface. In one or more embodiments, the apparatus includes a retainer section and a static mixer section, combined to form a retainer mixer assembly (RMA) tool, where the RMA tool may be used to mix an LCM curing composition downhole proximate to a loss zone in the well.

FIG. 1 is a generalized schematic illustrating a system and method for sealing a section of a well which is described in one or more embodiments herein. A retainer-mixer assembly (RMA) tool 100, made up of a retainer section 101 connected to a static mixer section 102 at a location uphole of the static mixer section. The RMA tool 100 is first set downhole in a well at a location just above a loss zone 103 by a dual path tubing 104 which is run into the well from surface equipment 105 located at an opening of the well 106. The dual path tubing has a first flow path 107 positioned within a second flow path 108. A first fluid is pumped from a first fluid source 109 through the first flow path 107 and a second fluid is pumped from a second fluid source 110 in the second flow path 108. The first fluid and the second fluid are kept separate from each other by way of the dual path tubing 104, until they are pumped through the retainer section 101 and allowed to mix in the static mixer section 102. The static mixer section 102 is designed to mix the first fluid and the second fluid to form a curing composition 111, which is pumped into the loss zone 103 and allowed to set.

In one or more embodiments, surface equipment may include a wellhead, a separator, a heater treater, false rotary table, a top-entry sub, a tank battery, and metering systems, for example.

Retainer-Mixer Assembly

One or more embodiments of the present disclosure relate to a downhole tool which includes a retainer section and a static mixer section, referred to herein as a retainer-mixer assembly (RMA) tool. An RMA tool may enable a squeeze job, where two streams, totally separated uphole from the RMA tool, are forced to mix in-situ at a high mixing rate through the static mixer section of the RMA tool. The retainer section may have components assembled together in a configuration that allows the RMA tool to be set in a downhole location in a well (e.g., using gripping elements and/or sealing elements) and that allows fluid to be selectively flowed through the RMA tool (e.g., using a downhole gate member, which may be a check-valve, a float valve, a non-return valve, or other one-way valve type component). The static mixer section may include a static mixing device, which contains one or more static mixing blades. In one or more embodiments, a static mixer section is a pipe filled with internal structures designed to force two streams to mix at a high mixing rate, with no moving parts. The static mixer section of an RMA tool may be integrally formed with a retainer section of the RMA tool, or the static mixer section may be a separate component that is attached to an axial end of a retainer section of the RMA tool. All components of the RMA tool may be made of drillable materials so that the RMA tool can be drilled out after the job is completed.

Figure 2:
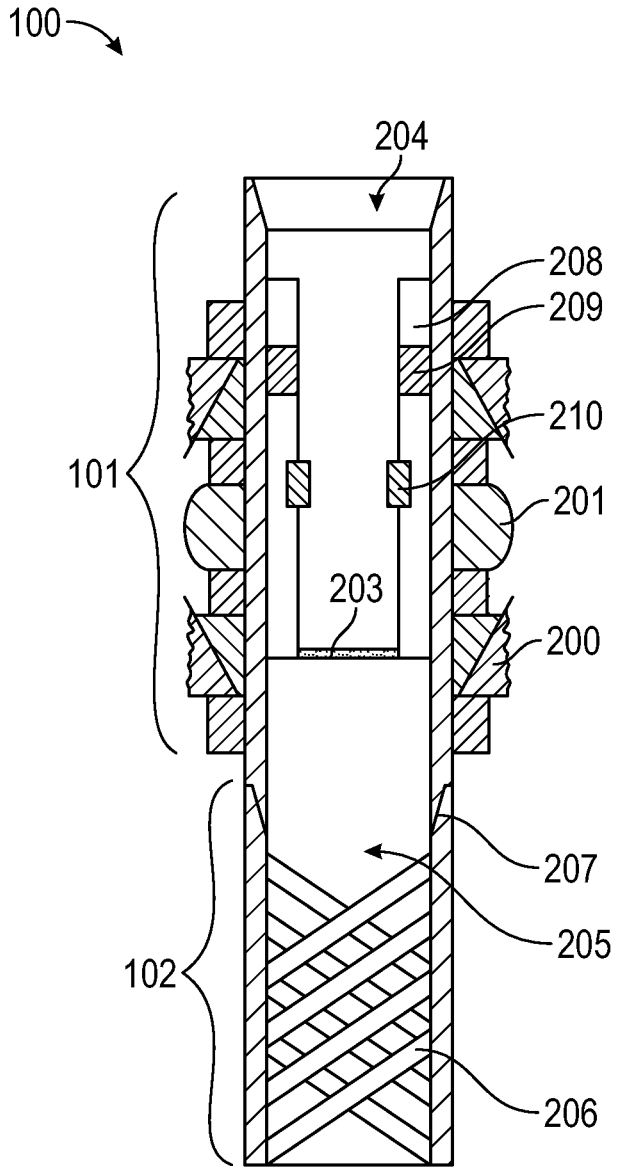
FIG. 2 shows an RMA tool described in one or more embodiments.

As illustrated in FIG. 2, an RMA tool 100 may include a retainer section 101 that includes one or more of the same or corresponding components as a cement retainer, where the retainer section 101 may be used to both set the RMA tool 100 in a downhole location in a well and selectively open and close fluid flow through the RMA tool.

For example, as shown in FIG. 2, the retainer section 101 includes a set of slips 200, which, when energized, radially protrudes from the retainer section of the RMA tool 100 to contact and grip the well wall. Additionally, the retainer section 101 includes at least one sealing element 201, which, when energized, protrudes outwardly from the retainer section 101 of the RMA tool 100 to contact the well wall and produce a hydraulic seal. In one or more embodiments, the RMA tool 100 may be set hydraulically. The RMA tool 100 may be set hydraulically by pumping fluid (such as drilling mud), dropping a ball or a plug, for example, that closes the bottom of the drill pipe, causing pressure build up which sets the slips 200 and the sealing element 201 of the RMA tool 100. RMA tool 100 may be set by expanding slips 200 and/or a sealing element 201 in a radially outward direction using any method known in the art.

The retainer section 101 may include an inner sleeve 208 with one or more ports 209 formed through the inner sleeve 208. The ports 209 may initially be closed when the RMA tool 100 is set in a well, such that fluid is prevented from flowing through the ports 209. In one or more embodiments, the ports 209 may be mechanically opened by using a tubing component (e.g., the axial end of an inner tubing or dual path tubing, a sub at the axial end of a dual path tubing, etc.) to move the inner sleeve 208 (e.g., axially or rotationally move the inner sleeve) to a position in the retainer section 101 where one or more ports 209 align with a corresponding flow path through the retainer section 101. The tubing component may move the inner sleeve 208 by contacting and moving a sleeve activator 210, which is operatively connected to or integral with the inner sleeve 208. For example, a sleeve activator 210 may include a J-slot formed in the inner sleeve, one or more protruding features (which may be pushed to move the inner sleeve axially downhole), one or more hooks, or other interlocking feature that may be contacted by and manipulated by a tubing component to move the inner sleeve. In some embodiments, ports 209 may be hydraulically opened. When the ports 209 are opened, fluid flow is allowed through the inner sleeve 208 and through one or more flow paths formed through the retainer section 101 to the static mixer section 102 of the RMA tool, as discussed more below. Such flow path(s) fluidly connectable to the inner sleeve ports 209 may be formed through a radially outer portion of the retainer section 101, and thus may be referred to as an outer flow path of the retainer section 101.

Additionally, the retainer section 101 may include an inner flow path, which may be formed radially inward of the outer flow path(s) (e.g., along a central axis) through the retainer section 101. A moveable gate member (for example, a flapper valve) 203 may be positioned along the inner flow path to selectively open/close the inner flow path through the retainer section 101. The gate member is configured to control the direction of fluid flow through the inner flow path of the retainer section 101, where fluid may flow from an upper flow passage 204 (upstream of the retainer section 101) to a lower flow passage 205 (downstream of the retainer section 101) through the RMA tool 100, but is prevented from flowing in the opposite direction.

A static mixer section 102 of the RMA tool 100, as shown in FIG. 2, has a tubular or annular body (e.g., a pipe) filled with internal structures, e.g., at least one static mixing blade 206, extending through the lower flow passage 205 through the annular body in the static mixer section 102. In one or more embodiments, the retainer section 101 is attached by way of a threaded connection 207 to the static mixer section 102 and at a position uphole in relation to the static mixer section.

In one or more embodiments, the length of the static mixer section 102 of FIG. 2 should be sufficient to assure proper mixing of the first fluid from the first fluid source 109 and the second fluid from the second fluid source 110. The length of the static mixer section 102 may be determined experimentally prior to drilling operations by calculating the Reynold's number required to produce laminar flow. Laminar flow in a pipe occurs when the Reynold's number is less than the dimensionless value 2300. Reynold's number for flow in a pipe or tube is determined according to the following equation:

$$Re = WD_H/\mu A \qquad \text{Equation 1}$$

where Re is the Reynolds number, W is the mass flowrate of the fluid, $D_H$ is the hydraulic diameter of the pipe, $\mu$ is the dynamic viscosity of the fluid, and A is the cross-sectional area of the pipe.

In one or more embodiments, the length of the static mixer section 102 of FIG. 2 may be extended in order to achieve laminar flow based on the calculated Reynolds number of Equation 1. The length of the static mixer section 102 may be extended by increasing the length of the static mixer section and blade, and/or connecting a plurality of mixers in series in an axial end-to-end fashion.

Keeping with FIG. 2, in one or more embodiments, a retainer section 101 and a static mixer section 102 may each be formed as separate assemblies, which may be connected together at axial ends, e.g., via a threaded connection 207. In some embodiments, a retainer section 101 and a static mixer section 102 may be formed from a single, integrally formed body.

Figure 3:
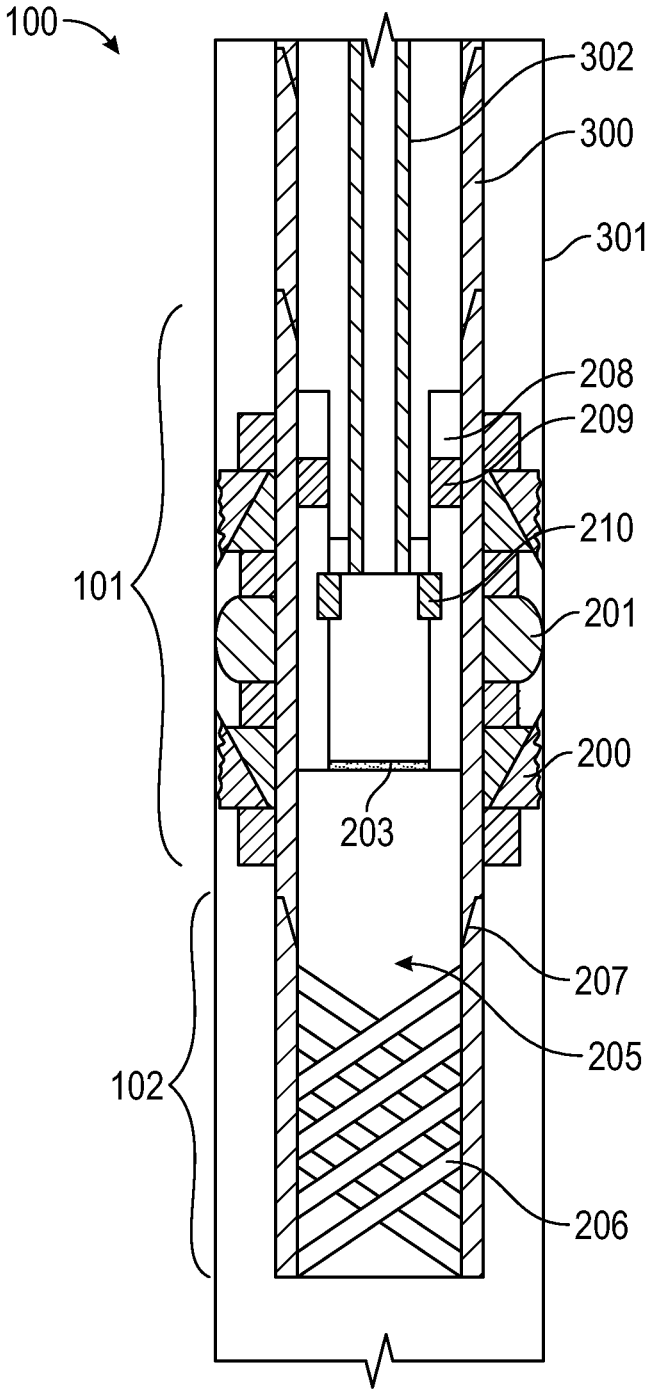
FIG. 3 shows how an RMA tool may be set in accordance with one or more embodiments.

FIG. 3 shows how the RMA tool may be set in a downhole location in a well in accordance with one or more embodiments. The RMA tool 100 may be connected to a drill pipe 300 and run down hole, parallel to the well wall 301. While the RMA tool 100 is being run downhole, drilling mud is constantly being circulated through the drill string and the RMA assembly. When the RMA tool 100 is in a selected downhole location, the RMA tool 100 may be set (e.g., using the drill pipe 300) to radially protrude the slips 200 from the retainer section 101 to grip the well wall 301 and to radially protrude the sealing element 201 from the retainer section 101 to contact and seal against the well wall 301.

In the setting step of FIG. 3, the gate member 203 is in the first axial position, wherein the upper flow passage 204 is sealed from the lower flow passage 205. In the first axial position, a gate member 203 may keep one or more connecting inner flow paths between the upper 204 and lower portions 205 of the flow passage closed. In such manner, the gate member 203 may act as an isolation valve. Once the RMA tool 100 is set, an inner tubing 302 is run through the drill pipe 300, where the drill pipe 300 acts as an outer tubing in this example. The inner tubing 302 and drill pipe 300 form the dual path tubing 104 of one or more embodiments. The inner tubing 302 may be seated on the sleeve activator 210 of the sleeve 208 in the retainer section 101. Once the inner tubing 302 is seated on the sleeve activator 210, the RMA tool 100 may be used to create dual flow paths as illustrated in FIG. 4.

Figure 4:
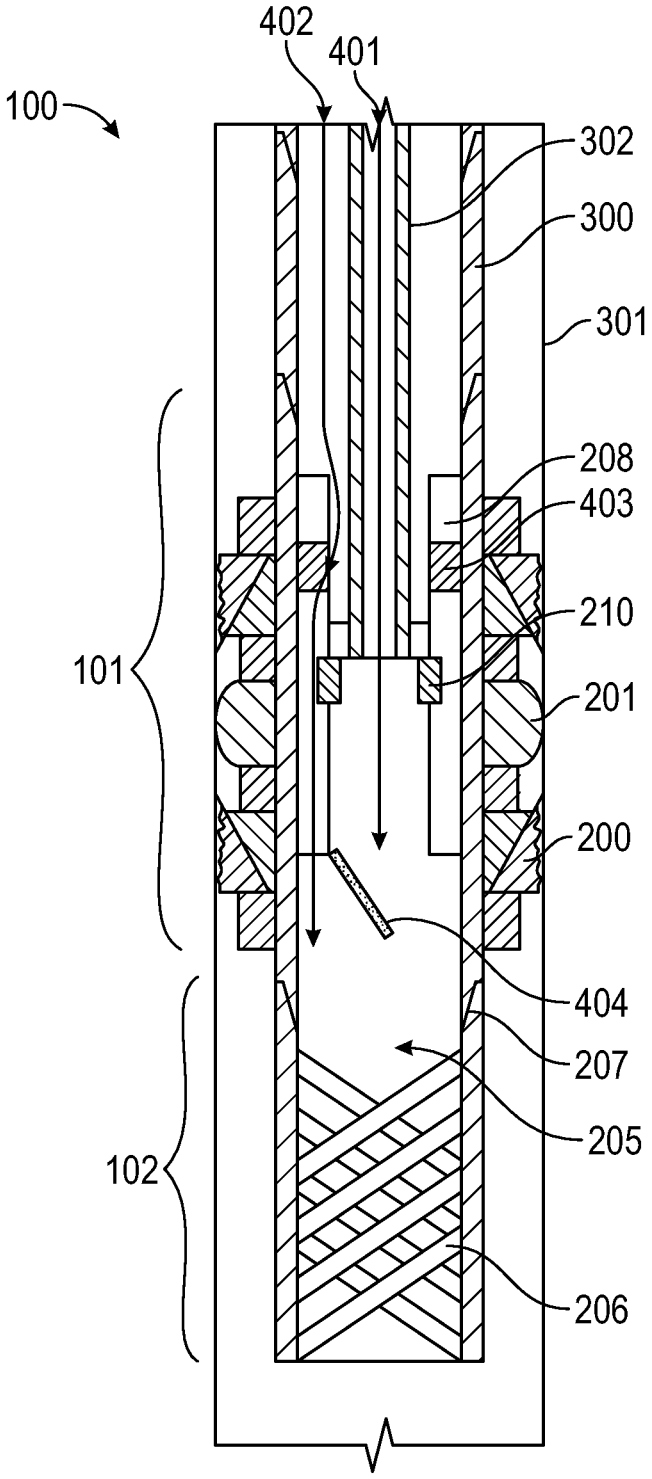
FIG. 4 shows how an RMA tool may be stung into by an inner string of tubing according to embodiments disclosed herein.

FIG. 4 illustrates an example of the creation of dual flow paths through the retainer section 101 in accordance with one or more embodiments. For example, in FIG. 4, drilling mud is pumped down the drill string 300, causing a hydraulic pressure build-up on the gate member 203. The increase in hydraulic pressure exerted by the drilling mud on the gate member causes the gate member 203 to an open configuration 404 (e.g., by shifting to a second axial position), in which the upper flow passage 204 becomes fluidly connected to the lower flow passage 205 via an inner flow path through the retainer section 101.

When the gate member of FIG. 4 is shifted to an open configuration 404, a first flow path 401 is created by which a first fluid 109 may flow through the inner tubing 302 and through the inner flow path of the retainer section 101 to the static mixer section 102 of the RMA tool. At the same time, the inner tubing 302 may be used to manipulate the sleeve activator 210 (e.g., by pushing or rotating the sleeve activator), causing the inner sleeve ports 209 to be in an open configuration 403, where the ports 209 are fluidly connected to one or more outer flow paths formed through the retainer section 101. A second flow path 402 is thereby established as the annulus created between the inner surface of the drill pipe 300 and the outer surface of the inner tubing 302 and the outer flow path(s) formed through the retainer section 101. A second fluid 110 may then flow through the second flow path (through the dual path tubing annulus, through the open ports 403 of the inner sleeve 208, and through the outer flow path(s) in the retainer section 101), by-passing the open gate member 404, directly to the static mixer section 102. Thus, when a first fluid 109 flows through the first flow path 401 and a second fluid 110 flows through the second flow path 402 from the dual path tubing 104 created by the drill pipe 300 and inner tubing 302 in the example of FIG. 4, the first fluid 109 and second fluid 110 may be separately pumped through the dual path tubing 104 and retainer section 101 until they contact each other when they reach the static mixer section 102. When the first and second fluids 109, 110 reach the static mixer section 102, they become thoroughly mixed by the static mixing blades 206 in the static mixer section 102.

Concentric Dual Path Tubing

One or more embodiments of the present disclosure relate to creating two separate flow paths to mechanically isolate two fluids until they are ready to be mixed in the RMA tool. To do so, a concentric dual path is constructed out of tubing. In the art, tubing may refer to different types of pipes, such as tubing, drill pipe, casing, coiled tubing, etc., used as conduits for fluids in an oil or gas well. Several different methods can be used to create concentric dual path tubing. The following examples are intended for illustrative purposes only and are not to be taken as limiting.

Coiled Tubing or Tubing Inside Drill Pipe or Casing

One example of creating concentric dual path tubing is running coiled tubing inside of a drill pipe string. Coiled tubing or tubing may also be run through casing which is already set in the wellbore or being installed in the wellbore to form a dual path tubing. When using a dual path tubing formed of coiled tubing inside a drill pipe string or casing, such dual path tubing may be connected to an RMA tool using different methods. For example, in one method of system set-up, an RMA tool may first be set in-hole using a drill pipe string, and then the same drill pipe string is stung in the RMA tool to open the flow passage through the RMA tool. Alternatively, if another method (e.g., wire-line, slick-line, or coiled-tubing) is used to set the RMA tool, a string of drill pipe is then run-in-hole until it stings in the RMA tool to open the flow passage through the RMA tool. Then, a cross-over and a coiled tubing blowout preventer (CT BOP) may be installed on top of the last joint at the top of the drill pipe string. At this point, the drill pipe string may be supported on the rotary table using slips. Coiled tubing is then run through the CT BOP, inside the drill pipe string, until it reaches the set RMA tool. The CT BOP can be used to seal the annular area between the coiled tubing and the drill pipe, and the CT BOP kill-line can be used to pump through this same area.

Another example of creating concentric dual path tubing includes running a smaller drill pipe string (tubing) inside of a larger drill pipe string. In such embodiments, the RMA tool may first be run in-hole using a drill pipe string to a selected downhole location in the well. The same drill pipe string may then be used to set the RMA tool in the selected downhole location. Alternatively, if another method (e.g., wire-line, slick-line, or coiled-tubing) is used to set the RMA tool, a string of drill pipe is run run-in-hole until it stings in the RMA tool. The last joint on top of this drill pipe string, is a "top-entry". At this point, the drill pipe string is supported on the rotary table using slips. A false rotary table is then rigged up above the top-entry sub. Tubing joints are then run on the false rotary table, through the top-entry sub, inside the drill pipe string. Tubing is run-in-hole until it reaches the retainer section of the RMA tool or sets in a dedicated seat inside the drill-pipe.

In one or more embodiments, when running coiled tubing or tubing inside a drill pipe string along with the RMA tool, the following measures can be taken to minimize the risk of getting stuck in hole by the drill pipe or tubing. In one aspect, a gate member may be used at the end of the inner tubing, at the bottom of an injection sub. A gate member requires a pre-set differential pressure to allow flow only in one direction to the outside of the pipe. This may prevent mixing of the first fluid and second fluid while the inner tubing is being run-in-hole or while pulling-out-of-hole. If the first fluid and the second fluid mix prematurely, the downhole reaction intended to plug loss circulation zones will occur too soon and may plug the string. Similarly, if the first fluid and second fluid are allowed to mix while pulling-out-of-hole, the downhole reaction may continue to occur and, again, the string may be plugged. In another aspect, a sting-in perforated seat may be used at the end of the drill-pipe for the tubing to sting into. This creates additional pressure drop across the seat and minimizes the risk of back-flow of the mixed streams above the seat into the annular area between the drill pipe and the tubing.

In one or more embodiments, when running coiled tubing or tubing inside a drill pipe string along with the RMA tool, the following measures can be taken to reduce the risk of either of the strings getting stuck in hole because of the LCMs or chemical curing compositions. In one aspect, the last pipe joint at the bottom of the inner string can either be made of drillable material and/or have a left-hand connection. The last joint of the inner string may also contain a gate member, such as a flapper valve. If the bottom of the string gets stuck with this connection at the bottom, rotating the string in the positive direction will break the connection and free the rest of the pipe, leaving only one drillable joint downhole above the RMA tool. In another aspect, the coiled tubing may be equipped at the bottom with a ball-drop disconnect or a hydraulic disconnect followed by a drillable injection sub. Ball-drop and hydraulic disconnects may be those available commercially and are used for releasing the bottomhole assembly in coiled-tubing operations in case it gets stuck.

Figure 5B:
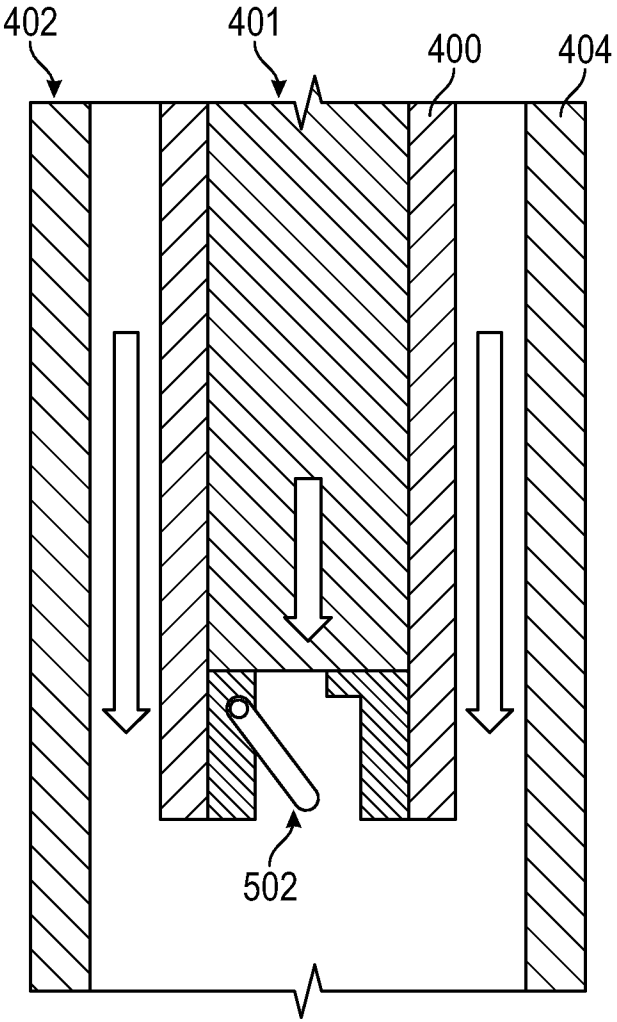
FIGS. 5A-B show how a flapper valve may be used with the concentric dual tubing in accordance with one or more embodiments.
Figure 5A:
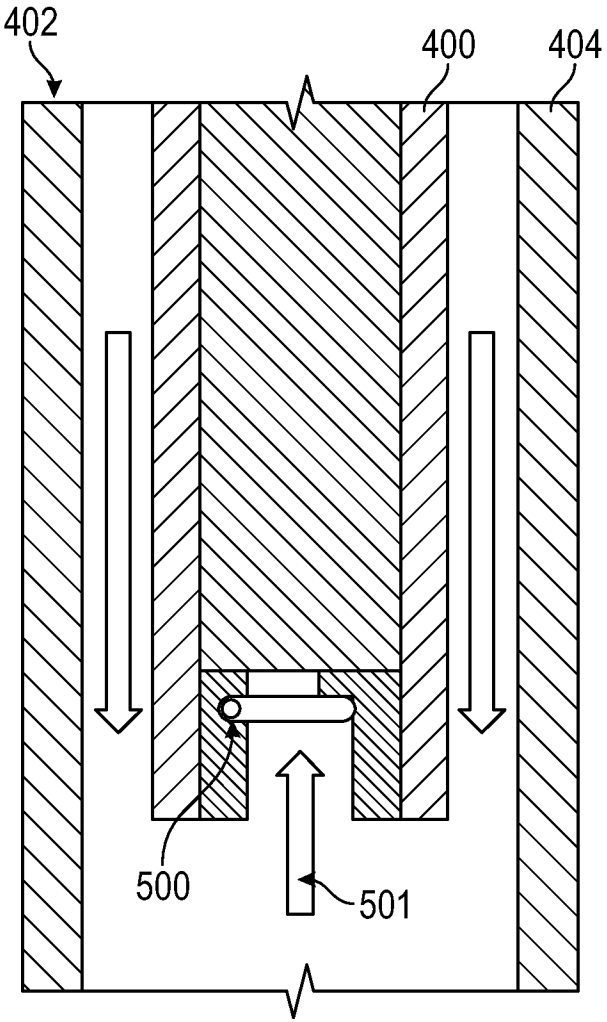

FIGS. 5A and 5B show an example of how a downhole flapper valve may be operated in the concentric dual tubing according to one or more embodiments herein. The flapper valve of FIG. 5A is shown attached to the last joint of the inner tubing 302. In FIG. 5A, the inner tubing 302 may be tubing or coiled tubing. The flapper valve is initially in the closed position 500, while no fluid is being pumped down the first flow path of the inner string 302. At the same time, a second flow path 402 is created in the annulus between the inner tubing 302 and an outer tubing 300. In one or more embodiments, the outer tubing 300 may be casing which is already set in the well or being set in the well, a drill pipe string, coiled tubing, or other tubular bodies known in the art. This prevents drilling mud or other downhole fluids 501 from entering the inner string. In FIG. 5B, fluid is pumped down the inner tubing 302 through a first flow path 401. The hydraulic pressure exerted from the fluid pumped through the first flow path 401 causes the flapper valve to open 502.

In one or more embodiments, a gate member positioned at the end of an inner tubing may be fitted within an RMA tool to provide the gate member of the RMA tool (e.g., by fitting the gate member along an inner flow path of the RMA tool, such as described above with respect to FIG. 2). In some embodiments, a gate member positioned at the end of an inner tubing may be separate from and used in addition to a gate member provided in the RMA tool.

Figure 6B:
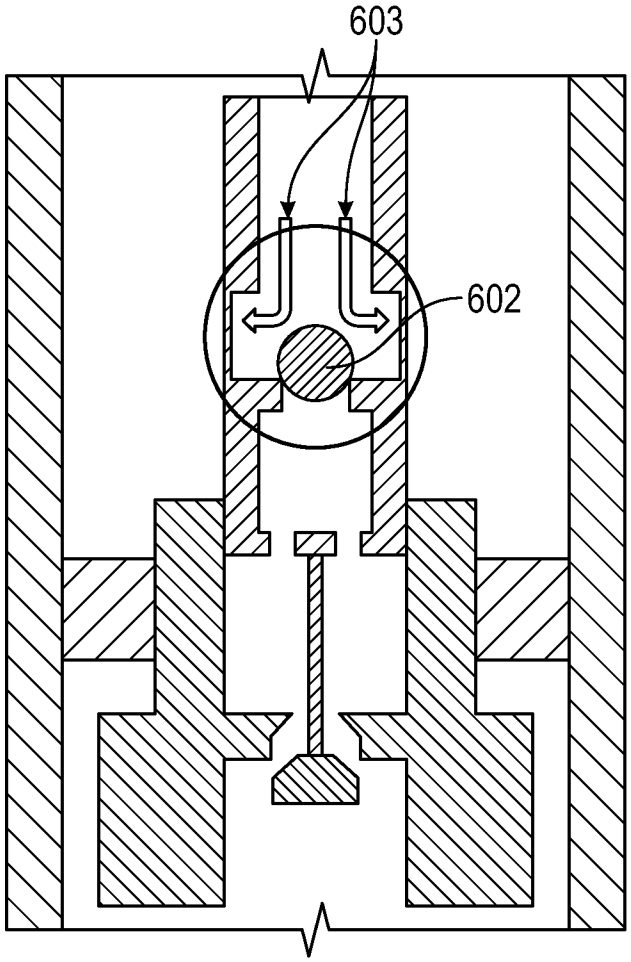
FIGS. 6A-B show how a ball-drop disconnect may be used with the concentric dual tubing in accordance with one or more embodiments.
Figure 6A:
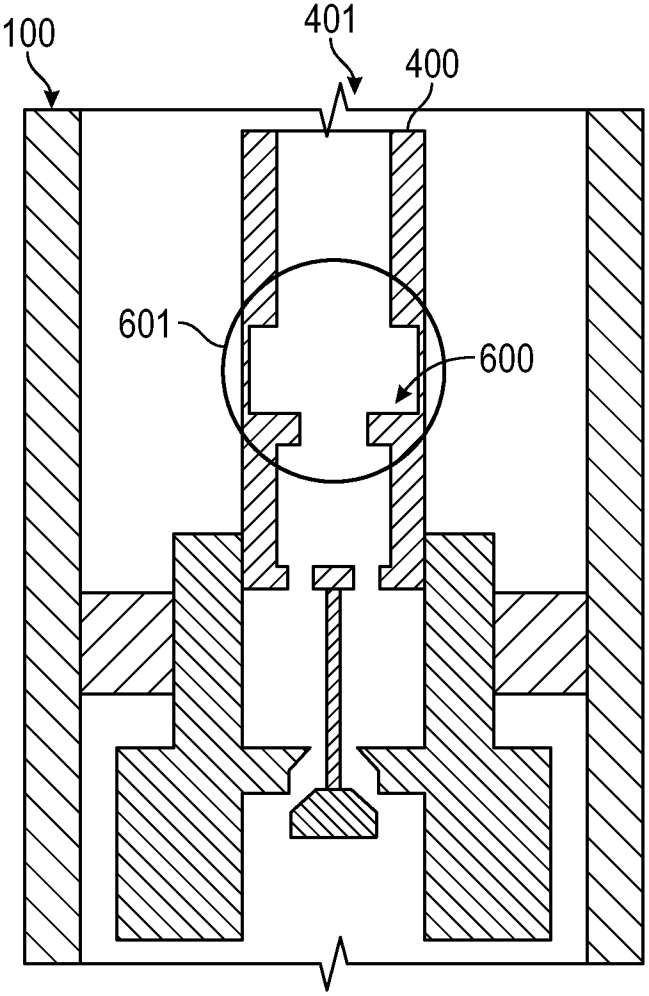

FIGS. 6A and 6B show an example of how a ball-drop disconnect may be used in the concentric dual tubing according to one or more embodiments herein. A ball-drop disconnect assembly may be attached to the inner tubing 302 which is run-in-hole inside the RMA tool 100. A ball seat 600 is located at a point in the inner tubing 302 at a point immediately uphole of a weakest point in the tubing 601 (e.g., formed of a thinned or scored portion of the tubing). In FIG. 6B, a ball is seated 602 in the inner tubing 302, blocking fluid flow through the bottom joint of the inner tubing 302. When fluid is pumped down the inner tubing 302 through the first flow path 401, the hydraulic pressure exerted from the fluid 603 pumped through the first flow path 401 causes fluid to flow out of the weakest point in the string 601, disconnecting the ball-drop assembly from the last joint of the inner tubing 302.

Top-Entry Sub

In one or more embodiments, a top-entry sub is a type of surface equipment which may enable flow through both the inner and outer strings. The main components of the top-entry sub may include a top-entry port, where tubing can be run inside the drill-pipe, while maintaining pressure isolation around it and a side port that enables pumping inside the drill-pipes, in the area outside the tubing. In one aspect, the top-entry sub may be installed on the drill pipe string and tubing can be run through it. At the same time, two different, separate streams can flow through both the drill pipes and the tubing independently. A top-entry sub may be used when a dual path tubing is formed by running coiled-tubing inside a drillpipe string or running tubing inside a drillpipe string.

Figure 7:
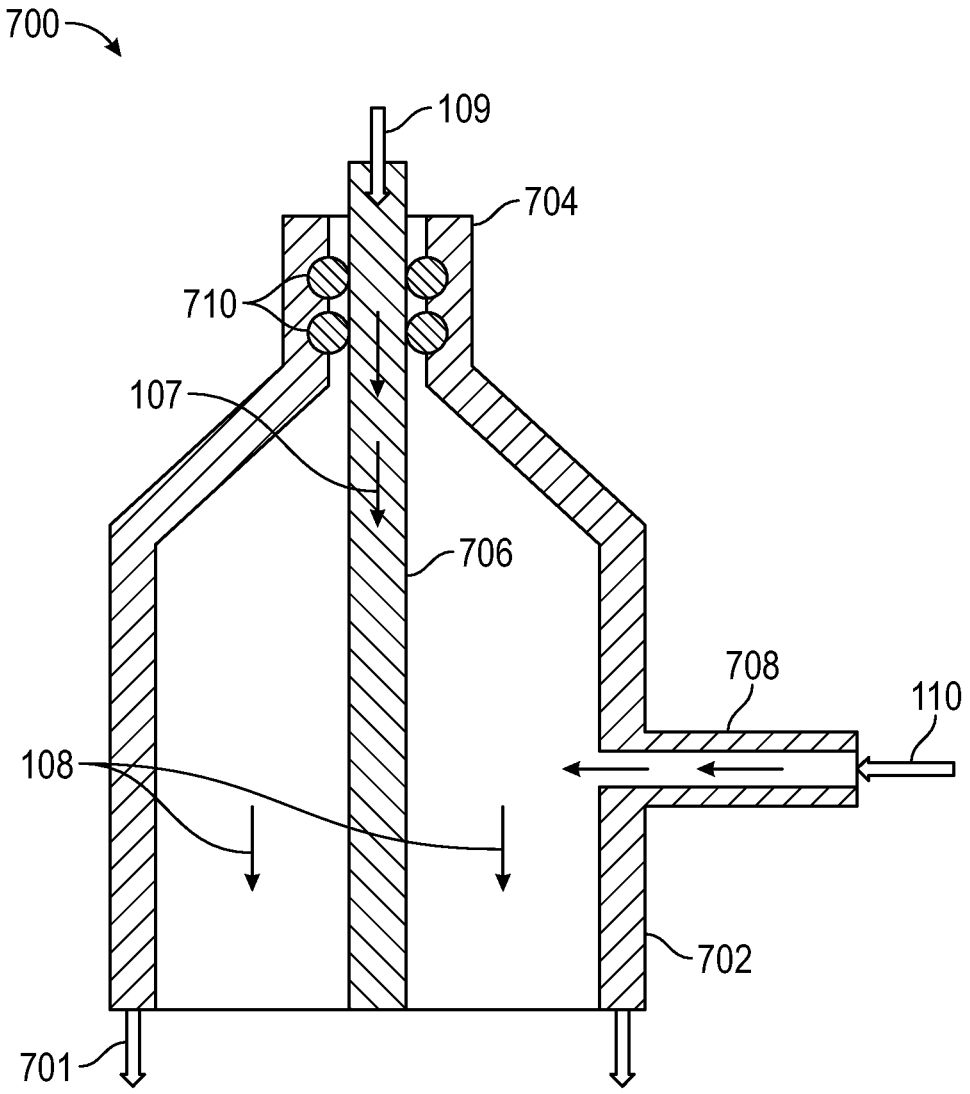
FIG. 7 shows a top-entry sub connection for dual path tubing according to embodiments of the present disclosure.

For example, FIG. 7 shows an example of a top-entry sub 700, which is connected as the top, last joint of a drill pipe string 701 at the surface of a well. As shown in FIG. 7, the top-entry sub 700 includes a body 702 that is connected to a drill pipe string 701 via a threaded connection. The body 702 has a generally cylindrical shape corresponding in size with the connected drill pipe string 701 and an upper end that decreases in diameter to an upper port 704. A smaller pipe string 706 (providing a first flow path 107 there though) is inserted through the upper port 704 and into the drill pipe string. The smaller pipe string 706 may be held above the top-entry sub, for example, using a false rotary table. Tubing joints of the smaller pipe string 706 may be run on the false rotary table, through the top-entry sub 700, inside the drill pipe string. Additionally, one or more pressure isolation seals 710 may be provided between the smaller pipe string 706 and the upper port 704 to pressure seal the area between the top-entry sub 700 and the smaller pipe string 706. A connection line to a first fluid source 109 may be fluidly connected to the smaller pipe string 706 to flow a first fluid through the first flow path 107 formed through the smaller pipe string 706. A second flow path 108 formed inside the top-entry sub 700 between the smaller pipe string 706 and the body 702 of the top-entry sub 700 may be in fluid communication with a flow port 708 formed around the body 702 of the top-entry sub 700. A connection line to a second fluid source 110 may be fluidly connected to the flow port 708 to flow a second fluid source 110 through the second flow path 108.

Nested Drill Pipe

Another example of creating concentric dual path tubing is using a nested dual drill pipe. The nested dual drill pipe consists of two (smaller and larger inner diameter) pipes. The larger diameter pipe has a pin end and a box end. The inner tube is fixed concentrically in the larger outer tube via retainer features on both the inner and outer tube, similar to the design in WO 2013/104770 A2 or any other mechanical nested pipes fixing methods.

Concentric Coiled Tubing

Another example of creating concentric dual path tubing is using concentric coiled tubing. The concentric coiled tubing consists of two (smaller and larger inner diameter) coiled tubings. To set the RMA tool in the case of concentric coiled tubing, a ball may be pumped through the manifold into the inner coiled tubing where the pressure build up would set the slips and sealing element of the retainer section of the RMA tool. The ball seat may be shifted by increasing pumping pressure to open the flow path again. The seat and entire ball drop assembly can be connected to the bottom of the concentric tubing. Setting the RMA tool in concentric coiled tubing may be accomplished by any methods for setting a cement retainer known in the art.

Curing Composition

In one or more embodiments, a curing composition is proposed which includes two fluids. The first fluid may be a base material and may include one or more chemicals or materials and one or more additives. The second fluid may be an activating agent and may include one or more chemicals or materials and one or more additives. The following examples are intended for illustrative purposes only and are not to be taken as limited.

One or more embodiments herein relate to delivering fluids to a downhole location which react quickly (e.g., less than 1-3 min) to form a cured material. Therefore, considerations in reaction time are very important. Pumping the fluids is conducted very carefully to prevent complications which may cause late or premature setting of the curing composition. The downhole reaction rate might have multiple uncertainties, mainly due to the uncertainty associated with the downhole temperature of the formation and the temperature of the chemicals as they arrive at the RMA tool. Such discrepancies in the actual temperature and the design temperature can lead to discrepancies in the solidification reaction rate. This in turn can cause either late setting of the chemicals or pre-mature setting. Late setting means that the chemicals have already drifted far away into the loss-zone. This defeats the whole purpose of the present embodiments. Pre-mature setting means that the chemicals set early on, inside the drill string. In this case, the loss zone is not cured because the fluid path is blocked too soon.

In order to avoid such issues, in one or more embodiments, the activating agent can be pumped at a variable rate in time. For example, the rate of pumping the activating agent may be calculated using the following procedure.

The maximum potential temperature of the wellbore is estimated and used to estimate the maximum reaction rate ($R_{max}$) of the base material and the activating agent. $R_{max}$ is then used to estimate the lower limit of the required concentration of activating agent ($XB_{min}$). $XB_{min}$ is then used to calculate the minimum corresponding flow rate of the activating agent ($NB_{min}$).

The minimum potential temperature of the wellbore is then estimated, being the bottom hole circulating temperature, and is used to estimate the minimum reaction rate ($R_{min}$) of the base material and the activating agent. $R_{min}$ is then used to estimate the upper limit of the required concentration of activating agent ($XB_{max}$). $XB_{max}$ is then used to calculate the maximum corresponding flow rate of the activating agent (NB max).

These two limits are used to pump the activating agent, starting from NB min, then increasing the flow rate linearly until reaching $NB_{max}$ towards the end of the pumping job.

In some embodiments, the reaction time of a curing composition may be engineered by selecting the types of the base material and the activating agent, selecting the ratio of base material to activating agent pumped downhole, and/or the pumping rate of the base material and activating agent based at least in part on the downhole temperature and pressure in the well at the selected downhole location to be sealed.

The reference hydrodynamic time-scale (TH) in this process is the time required for fluid to travel through a static mixer section of an RMA tool, then through open hole, until it reaches the loss zone. The solidification reaction time-scale ($\tau_R$) of the first and second fluids is designed to be of same order (ideally, equal to or slightly longer than (TH)). When these time scales are maintained, the mixture will solidify in place and cure the loss zone. After that, the inner flow path (in some instances, the coiled tubing) is pulled out of hole, then the outer path (in some instances, the drill string) is pulled out of hole. This leaves downhole the "drillable" RMA tool with the LCM sealed in place. The drilling crew can then run-in-hole a drilling assembly, clean out the RMA tool, and continue drilling operations after re-gaining circulation at the cured zone.

Examples of suitable base materials and activating agents used to form curing compositions according to embodiments of the present disclosure are discussed in more detail below.

Base Material

The base material may be a single component, or a mixture of components including additives.

The base material may include an epoxy resin. The epoxy resin may include, but is not limited to, bisphenol-A-based epoxy resins, bisphenol-F-based epoxy resins, aliphatic epoxy resins, Novalac resins, or combinations of these epoxy resins. The epoxy resin may include at least one of 1,6-hexanediol diclycidyl ether, alkyl glycidyl ethers having from 12 to 14 carbon atoms, 2,3-epoxypropyl o-tolyl ether, or bisphenol-A-epichlorohydrin epoxy resin. Alternatively, in other embodiments, the epoxy resin may include at least one of 1,6-hexanediol diclycidyl ether, alkyl glycidyl ethers having from 12 to 14 carbon atoms, or 2,3-epoxypropyl o-tolyl ether. The epoxy resin may be modified with a reactive diluent. The reactive diluents may be added to improve at least one of the adhesion, the flexibility, and the solvent resistance of the epoxy resin. Examples of reactive and non-reactive diluents may include, but are not limited to, propylene glycol diglycidyl ether, butanediol diglycidyl ether, cardanol glycidyl ether derivatives, propanetriol triglycidyl ether, aliphatic monoglycidyl ethers of C13-C15 alcohols, other reactive or non-reactive diluents, or combinations of reactive and non-reactive diluents.

The base material may include an alkaline nanosilica dispersion.

The base material may include an acidic nanosilica dispersion.

The base material may include a regular portland cement.

The base material may include an acid soluble magnesia cement.

Activating Agent

The activating agent may be a single component, or a mixture of components including additives.

The activating agent may include a curing agent. The curing agent may include, but is not limited to, DETA (diethylenetriamine), TETA (triethylenetetramine), TEPA (tetraethylenepentamine), IPDA (isophoronediamine) and combinations thereof.

The activating agent may include a chemical activator. The chemical activator may include, but is not limited to, an ester based activator and an amine based activator.

An ester-based activator may include, but is not limited to, water-insoluble hydrolyzable polyester such as polylactide, polyhydroxyalkanoates, polyglycolide, polylactoglycolide, polycaprolactone and combinations thereof, which can be used to cure an alkaline nanosilica dispersion. In some embodiments, water-soluble hydrolyzable ester such as ethyl lactate, ethyl formate, ethylene glycol diacetate, diethylene glycol dilactate, ethylene glycol diformate and combinations thereof can be used to cure an alkaline nanosilica dispersion.

The combination of alkaline nanosilica dispersion with ester-based activators may result in a gelled solid based loss circulation material. In such embodiments, the ester undergoes hydrolysis in aqueous medium thereby generating acid. This acid acts an activator that destabilizes the alkaline nanosilica dispersion thereby resulting in a gelled solid.

An amine-based activator may include, but is not limited to, alkanolamines, including triethanolamine (TEA), and polyamines, further including diethylenetriamine, ethylenediamine, tetraethylenepetamine, triethylentetramine, pentaethylenehexamine, hexaethyleneheptamine and combinations thereof.

In some embodiments, an activating agent may include a salt solution. The salt solution may include, but is not limited to, monovalent, divalent, or trivalent halide salts, bicarbonates, carbonates, formates, silicates, and calcium chloride.

In some embodiments, an activating agent may include a gelling agent. The gelling agent may include, but is not limited to, sodium silicate.

Additives

Additives included in the base material may include, but are not limited to, bridging material, fibrous material, flaky material, and other materials having different particle sizes, calcium carbonate particles, fibers, mica, graphite, ester fibers, polypropylene fibers, starch fibers, polyketone fibers, ceramic fibers, glass fibers and nylon fibers.

Methods of Set Up and Use

According to embodiments of the present disclosure, an RMA tool may be used to seal a section of a wellbore. For example, in one or more embodiments, a method for scaling a downhole location in a wellbore may include running an RMA tool (as described herein to a location uphole of the selected downhole location and setting the RMA tool in the wellbore. In some embodiments, the section of the wellbore may include a loss zone, where the RMA tool is used to deliver a curing composition (e.g., as described herein) to seal the loss zone. A dual path tubing (e.g., as discussed herein) is fluidly connected between surface equipment at the surface of the well and the set RMA tool. After the RMA tool is set and the dual path tubing is fluidly connected between the surface equipment and the RMA tool, first and second fluids may be pumped through the dual path tubing to mix in the RMA tool.

Figure 8:
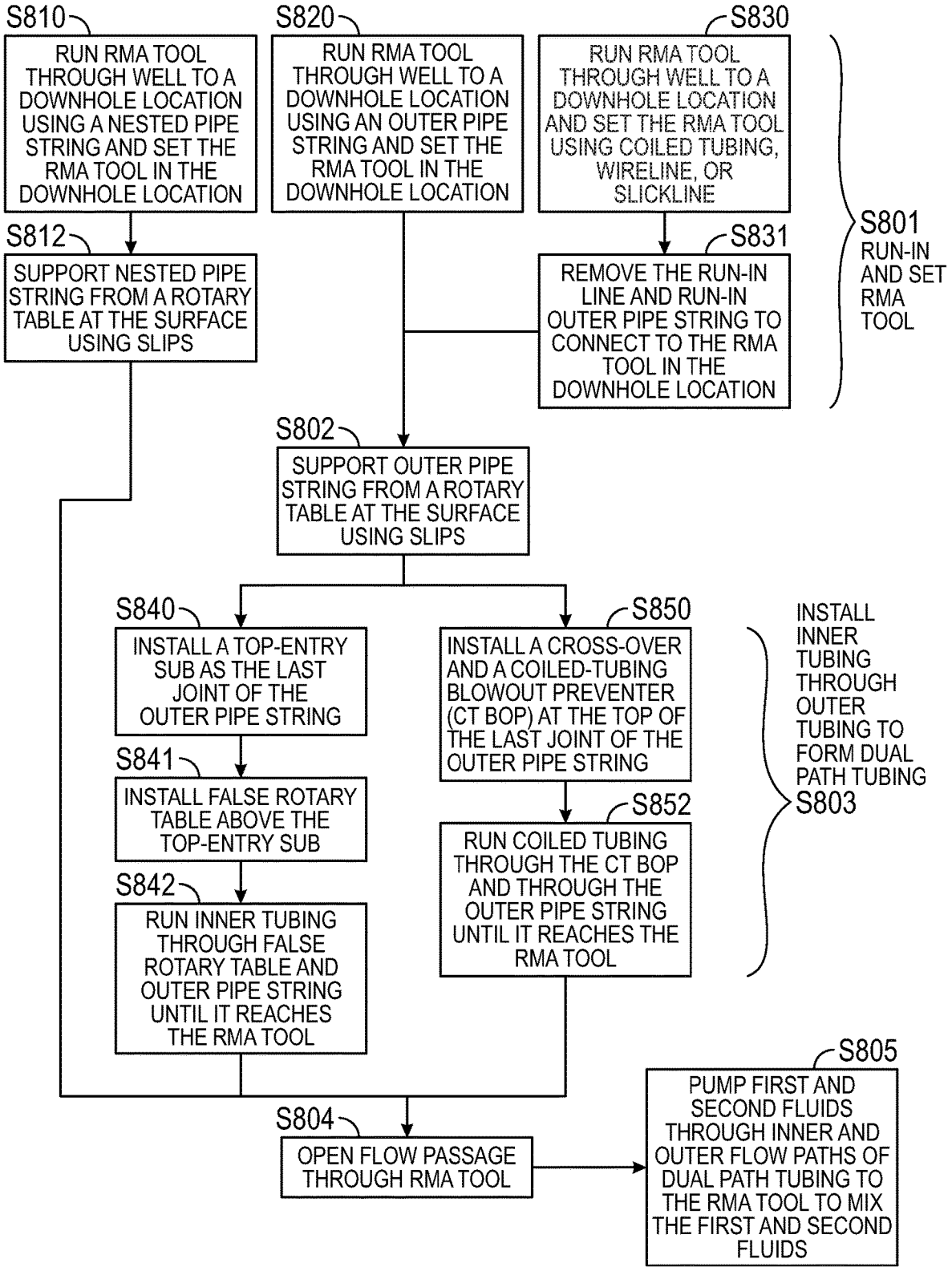
FIG. 8 shows a method diagram according to embodiments of the present disclosure.

FIG. 8 shows various examples of methods that may be used to run-in and set an RMA tool in a downhole location, providing dual path tubing from the surface of the well to the set RMA tool, pumping first and second fluids through the dual path tubing to mix in the RMA tool, and flowing the mixed fluids into the wellbore below the RMA tool to cure and seal the filled section of the wellbore.

As shown in FIG. 8, an RMA tool may be run-in a well to a downhole location and set using various types of run-in equipment, Step 801, such as using a nested (dual-walled) pipe string (Step 810), using an outer pipe (single-walled) string (Step 820), or using non-drill pipe strings, such as coiled tubing, wireline, or slickline (Step 830). In embodiments using nested pipe string or single-walled pipe string, an RMA tool may be set in the downhole location by connecting an upper axial end of the retainer section of the RMA tool (opposite the static mixer section) to an axial end of the pipe string, where the RMA tool is run-in to the downhole location at the axial end of the pipe string, and manipulating the pipe string (or using a ball drop) to move gripping elements and/or sealing elements of the RMA tool radially outward to contact the well wall, thereby setting the RMA tool. In embodiments using non-drill pipe strings to run-in the RMA tool, an RMA tool may be set in the downhole location by connecting an upper axial end of the retainer section of the RMA tool to an axial end of the run-in line, where the RMA tool is run-in to the downhole location at the axial end of the run-in line, and sending one or more signals (or ball drop through coiled tubing) to the RMA tool to move gripping elements and/or sealing elements of the RMA tool radially outward to contact the well wall, thereby setting the RMA tool.

When non-drill pipe lines are used to run-in and set an RMA tool, the run-in line may be removed after setting the RMA tool, and an outer pipe string may then be run-in the well to connect the axial end of the outer pipe string to the upper axial end of the retainer section of the RMA tool, Step 831.

After the RMA tool is set in the well, either a nested pipe string or a single-walled outer pipe string is connected between surface equipment at the surface of the well to the set RMA tool, where a nested pipe string provides an inner and outer (first and second) flow path and a single-walled outer pipe string provides an outer, second flow path fluidly connecting surface equipment to the RMA tool. The nested pipe string or the outer pipe string may be supported at the surface from a rotary table at the surface using slips, Steps 812, 802.

In embodiments where a single-walled outer pipe string is used to provide the outer, second flow path to the RMA tool, an inner tubing is then installed through the outer pipe string, Step 803, to provide the inner, first flow path. In some embodiments, where an inner pipe string having a smaller diameter than the outer pipe string is used to form the inner tubing, a top-entry sub may be installed as the top, last joint of the outer pipe string, Step 840. In such embodiments, a false rotary table may be installed above the top-entry sub, Step 841, and the inner tubing may be run through the false rotary table and outer pipe string until the inner tubing reaches the RMA tool, Step 842. In other embodiments, where a coiled tubing is used to form the inner tubing, a cross-over and a coiled-tubing blowout preventer (CT BOP) at the top of the last joint of the outer pipe string, Step 850, and coiled tubing is run through the CT BOP and through the outer pipe string until it reaches the RMA tool, Step 852.

In one or more embodiments, an injection sub may be provided at the axial end of the outer pipe string, where the injection sub connects the outer pipe string to the RMA tool. In some embodiments, the injection sub may be made of a millable material (e.g., the same material forming the RMA tool) and may be connected to the outer pipe string using a ball drop disconnect or a hydraulic disconnect, for example. In one or more embodiments, the injection sub may also include a gate member. The gate member may be opened either by applying pre-set differential pressure through the outer pipe string or mechanically by pushing the inner tubing through the gate member. Otherwise, the gate member is in a closed position which prevents downhole fluids from flowing back into the outer pipe string and prevents fluids inside the outer pipe string from flowing into or applying pressure on the RMA tool.

When a dual path tubing is moved downhole, fluid may be flowed through both the inner and outer tubings. For example, inner fluid flow through the inner tubing can come from a top-drive when tubing is used, and from the coiled-tubing unit when coiled-tubing is used. Outer fluid flow in the outer sub can come through a hose connected to the flow-port in the top-entry sub. The inner and outer fluid flow can come from two different sources and can be pumped at the same time without intermingling between the dual paths of the dual path tubing, and by using one or more gate members.

An end of the dual path tubing may be inserted into the RMA tool, such that the first and second flow paths formed through the dual path tubing are fluidly connected to the RMA tool. A gate member in the RMA tool may then be opened by applying hydraulic pressure to allow fluid to flow through the RMA tool, from an upper, retainer section of the RMA tool to a lower, static mixer section of the RMA tool, Step 804.

First and second fluids may then be pumped through inner and outer flow paths of the dual path tubing to the RMA tool to mix the first and second fluids, Step 805. The mixed fluid composition may then flow into the section of the well below the RMA tool to fill the section of the well with a volume of the mixed fluid composition. The mixed fluid composition is then allowed to cure to set and seal the section of the well.

In one or more embodiments, after the section of the well has been sealed, the dual path tubing may be removed from the well, and the set assembly (the RMA tool, the cured composition, and optionally an injection sub connected to the RMA tool) may be drilled through to continue drilling operations.

Accordingly, methods and systems disclosed herein allow for a process having the following order of operations: 1) set the RMA tool; 2) run in second path for dual path tubing (if second path was not provided when setting the RMA tool); 3) connect the first and second fluid sources to the dual path tubing; 4) sting the dual path tubing into the RMA tool to open the flow passage through the RMA tool; and 5) begin pumping the first and second fluids through the dual path tubing.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A method for sealing a downhole location in a wellbore, comprising:

setting an RMA tool at a location uphole of the downhole location, wherein the RMA tool comprises:

an annular body having an inner flow passage formed axially therethrough;

at least one gripping member positioned around an outer perimeter of a retainer section of the annular body;

an inner sleeve comprising an inner sleeve port formed therethrough, the inner sleeve movably positioned within the retainer section;

a gate member positioned in the inner flow passage, wherein, when the gate member is in a closed configuration, an upstream portion of the inner flow passage is sealed from a downstream portion of the inner flow passage by the gate member, and wherein, when the gate member is in an open configuration, the upstream portion of the inner flow passage is fluidly connected to the downstream portion of the inner flow passage; and a static mixer section of the annular body having at least one static mixing blade extending through the downstream portion of the flow passage;

inserting an end of a dual path tubing into the retainer section of the RMA tool, wherein the dual path tubing has a first flow path concentrically positioned within a second flow path;

opening the inner sleeve port in the inner sleeve to fluidly connect the second flow path with the static mixer section via an outer flow path formed through the retainer section and bypassing the gate member;

pumping a first fluid in the first flow path through the retainer section of the RMA tool and through the gate member to the static mixer section;

pumping a second fluid in the second flow path through the outer flow path of the retainer section of the RMA tool to the static mixer section;

mixing the first fluid and the second fluid in the static mixer section to form a curing composition;

filling the downhole location with a volume of the curing composition;

allowing the curing composition to set; and removing the dual path tubing from the wellbore.

2. The method of claim 1, wherein the dual path tubing is formed by running coiled tubing inside a drill pipe string.

3. The method of claim 1, wherein the dual path tubing is formed by running a first tubing string inside a second tubing string.

4. The method of claim 1, wherein the dual path tubing comprises a top-entry sub positioned at an axial end of the dual path tubing.

5. The method of claim 1, wherein the dual path tubing is formed by nested dual drill pipe.

6. The method of claim 1, further comprising opening a second gate member provided at an axial end of the dual path tubing to fluidly connect the first flow path of the dual path tubing to the inner flow passage through the RMA tool.

7. The method of claim 1, wherein the dual path tubing comprises a drillable injection sub connected at an axial end of the dual path tubing via a ball drop disconnect or a hydraulic disconnect.

8. The method of claim 1, wherein the first fluid comprises:

one or more of an epoxy resin, an acidic nanosilica dispersion, an alkaline nanosilica dispersion, a regular portland cement, and an acid soluble magnesia cement.

9. The method of claim 1, wherein the second fluid comprises:

one or more of a curing agent, a chemical activator, a salt solution, and a gelling agent.

10. The method of claim 1, wherein mixing the first fluid and the second fluid in the static mixer section to form a curing composition occurs in a time ranging from 1 to 3 minutes.

11. The method of claim 1, wherein pumping the second fluid in the second flow path further comprises:

pumping the second fluid at a variable rate in time, wherein pumping the second fluid begins at a minimum flow rate of the second fluid and increases linearly until reaching a maximum flow rate of the second fluid;

wherein a maximum reaction rate of the first fluid with the second fluid is estimated from a maximum potential well temperature;

wherein a lower limit of a concentration of the second fluid is estimated from the maximum reaction rate; and wherein the lower limit of the concentration of the second fluid is used to calculate the minimum flow rate of the second fluid.

12. The method of claim 1, further comprising using the end of the dual path tubing to open the inner sleeve port in the inner sleeve.

* * * * *